US012208316B2

(12) United States Patent
Sanchez et al.

(10) Patent No.: US 12,208,316 B2
(45) Date of Patent: Jan. 28, 2025

(54) MULTI-PIECE GOLF CLUB HEAD

(71) Applicant: Acushnet Company, Fairhaven, MA (US)

(72) Inventors: Richard Sanchez, Temecula, CA (US); Richard L. Cleghorn, Oceanside, CA (US); Ryuichi Sugimae, San Diego, CA (US); Peter Larsen, San Marcos, CA (US); Stephen Murphy, Carlsbad, CA (US); Hiroshi Kawaguchi, Aliso Viejo, CA (US); Kyle A. Carr, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 18/075,642

(22) Filed: Dec. 6, 2022

(65) Prior Publication Data

US 2024/0181303 A1 Jun. 6, 2024

(51) Int. Cl.
*A63B 53/04* (2015.01)

(52) U.S. Cl.
CPC ..... *A63B 53/0408* (2020.08); *A63B 53/0466* (2013.01); *A63B 2209/00* (2013.01)

(58) Field of Classification Search
CPC ... A63B 53/02; A63B 53/0416; A63B 53/042; A63B 53/0466; A63B 53/04
See application file for complete search history.

(56) References Cited

U.S. PATENT DOCUMENTS

| | | | | |
|---|---|---|---|---|
| 5,039,098 | A * | 8/1991 | Pelz | A63B 53/02 473/307 |
| 5,323,224 | A | 6/1994 | Zeider | |
| 6,878,073 | B2 * | 4/2005 | Takeda | A63B 53/0466 473/345 |
| 7,156,750 | B2 * | 1/2007 | Nishitani | A63B 53/0466 473/345 |
| 7,186,191 | B2 | 3/2007 | Chen | |
| 7,410,428 | B1 * | 8/2008 | Dawson | A63B 60/00 473/345 |
| 7,497,789 | B2 * | 3/2009 | Burnett | A63B 60/02 473/345 |
| 7,549,935 | B2 * | 6/2009 | Foster | A63B 53/0466 473/335 |
| 7,632,193 | B2 * | 12/2009 | Thielen | A63B 60/02 473/345 |
| 7,717,806 | B2 * | 5/2010 | Kubota | A63B 60/02 473/340 |
| 7,931,546 | B2 * | 4/2011 | Bennett | A63B 60/00 473/345 |

(Continued)

FOREIGN PATENT DOCUMENTS

| | | | | |
|---|---|---|---|---|
| CN | 105209133 A | * | 12/2015 | A63B 53/0408 |
| CN | 110064180 A | * | 7/2019 | A63B 53/0408 |
| JP | 2010273804 A | * | 12/2010 | A63B 53/0466 |

*Primary Examiner* — Alvin A Hunter
(74) *Attorney, Agent, or Firm* — Randy K. Chang

(57) ABSTRACT

A multi-piece, multi-material golf club head is disclosed herein. More specifically, the golf club head in accordance with the present invention utilizes multiple pieces of different materials to form a frontal portion of a golf club head, allowing more of the frontal portion of the golf club head to be made out of a lightweight material to match the lightweight material of the aft body of the golf club head.

14 Claims, 9 Drawing Sheets

(56) References Cited

U.S. PATENT DOCUMENTS

| | | | | |
|---|---|---|---|---|
| 8,419,569 | B2 * | 4/2013 | Bennett | A63B 53/04 473/345 |
| 8,435,137 | B2 * | 5/2013 | Hirano | A63B 53/0466 473/345 |
| 8,715,109 | B2 * | 5/2014 | Bennett | A63B 60/02 473/345 |
| 9,320,949 | B2 * | 4/2016 | Golden | A63B 53/0466 |
| 9,452,325 | B2 | 9/2016 | DeShiell | |
| 10,076,694 | B2 * | 9/2018 | Galvan | A63B 53/0466 |
| 2003/0220154 | A1 * | 11/2003 | Anelli | A63B 53/0466 473/327 |
| 2005/0026719 | A1 * | 2/2005 | Yang | A63B 60/00 473/305 |
| 2006/0105855 | A1 * | 5/2006 | Cackett | A63B 53/02 473/306 |
| 2006/0287125 | A1 * | 12/2006 | Hocknell | A63B 53/02 473/309 |
| 2006/0293116 | A1 * | 12/2006 | Hocknell | A63B 53/02 473/305 |
| 2008/0254909 | A1 * | 10/2008 | Callinan | A63B 53/02 473/305 |
| 2009/0291775 | A1 * | 11/2009 | Hirano | A63B 53/0466 473/345 |
| 2010/0304888 | A1 * | 12/2010 | Hirano | A63B 53/0466 473/348 |
| 2012/0142447 | A1 * | 6/2012 | Boyd | A63B 60/54 473/332 |
| 2014/0080634 | A1 * | 3/2014 | Golden | A63B 53/0466 473/345 |
| 2017/0028284 | A1 * | 2/2017 | Galvan | A63B 60/52 |
| 2018/0361216 | A1 * | 12/2018 | Galvan | A63B 60/00 |

* cited by examiner

MULTI-PIECE GOLF CLUB HEAD

FIELD OF THE INVENTION

The present invention relates generally to a multi-piece golf club head made out of different materials. More specifically, the golf club head in accordance with the present invention utilizes multiple pieces of different materials to form a frontal portion of a golf club head, allowing more of the frontal portion of the golf club head to be made out of a lightweight material to match the lightweight material of the aft body of the golf club head.

BACKGROUND OF THE INVENTION

In order to help improve the performance of a golf club head, golf club designers have continued to experiment with the utilization of different components at various locations of a golf club head to achieve different performance criteria. The challenge in the utilization of the different materials often comes when trying to bond these types of materials together in a golf club head that experiments such high impact forces.

U.S. Pat. No. 5,232,224 to Zeider illustrates the utilization of welding to joint together various components of a metal-wood type golf club that are all mainly made out of various metallic materials that are mainly stainless steel. Unfortunately, because the welding process can only join together metallic materials having similar properties, the welding methodology explained in U.S. Pat. No. 5,232,224 may not be applicable in situations where materials having significantly different properties needs to be joined.

U.S. Pat. No. 7,186,191 to Chen et al. illustrates a method where metallic materials having different properties can be joined together via brazing. More specifically, U.S. Pat. No. 7,186,191 discloses a method wherein a clearance is created between the striker plate and the body portion wherein a brazing material flows into the clearance through a capillary action to secure the two slightly different materials.

Conventional bonding methods such as welding and brazing may be very effective in joining together metallic components to a golf club head, but may not be effective when there is a need to join modern day lightweight materials such a composite type material.

U.S. Pat. No. 9,452,325 to DeShiell et al. discloses a multi-material golf club head wherein the lightweight crown can be made out of a composite material. Because composite does not lend itself well to conventional metallic bonding processes such as welding and brazing, U.S. Pat. No. 9,452,325 utilizes an adhesive to bond the components together. However, the usage of an adhesive, although effective in bonding composite type materials to metal at locations that does not experience high impact forces, it can have difficulty bonding these types of material near the striking face portion of the golf club head.

In order to provide a lightweight club head that bonds different materials having different properties near the striking face portion of a golf club head, there is a need to creatively design a golf club head with multiple different components with varying material properties and shapes to achieve the performance benefits of these new modern materials all while maintaining durability of the materials bonded.

BRIEF SUMMARY OF THE INVENTION

In some aspects, the techniques described herein relate to a golf club head including: a striking face component, having a return portion, located at a frontal portion of the golf club head, adapted to strike a golf ball, wherein the striking face component is made out of a first material, wherein the striking face component forms a leading edge of the golf club head, a lightweight face return extension, adapted to engage an aft portion of the striking face component, wherein the lightweight face return extension is made out of a second material, and a rear lightweight aft body, adapted to engage an aft portion of the lightweight face return extension, wherein a density of the first material is greater than a density of the second material, and wherein no portion of the striking face component is located beyond more than about 30.0 mm from the leading edge, measured along a z-axis.

In some aspects, the techniques described herein relate to a golf club head including: a striking face component, having a return portion, located at a frontal portion of the golf club head, adapted to strike a golf ball, wherein the striking face component is made out of a first material, wherein the striking face component forms a leading edge of the golf club head, a lightweight face return extension, adapted to engage an aft portion of the striking face component, wherein the lightweight face return extension is made out of a second material, and a rear lightweight aft body, adapted to engage an aft portion of the lightweight face return extension, wherein a density of the first material is greater than a density of the second material, wherein the golf club head has an Upper Extension Overlap Ratio of between about 1 and about 2.4, the Upper Extension Overlap Ratio defined as, $$\text{Upper Extension Overlap Ratio} = \frac{\text{Upper Frontal Overlap Distance } d3}{\text{Upper Rear Overlap Distance } d4},$$

and wherein the golf club head has a Lower Extension Overlap Ratio of between about 1 and about 2.4, the Lower Extension Overlap Ratio defined as, $$\text{Lower Extension Overlap Ratio} = \frac{\text{Lower Frontal Overlap Distance } d5}{\text{Lower Rear Overlap Distance } d6}.$$

In some aspects, the techniques described herein relate to a golf club head including: a striking face component, having a return portion, located at a frontal portion of the golf club head, adapted to strike a golf ball, wherein the striking face component is made out of a first material, wherein the striking face component forms a leading edge of the golf club head, a lightweight face return extension, adapted to engage an aft portion of the striking face component, wherein the lightweight face return extension further includes; an upper hosel opening, adapted to engage a hosel adapter, and a lower hosel opening, adapted to engage a lower hosel component, wherein a threaded fastener engages the hosel adapter via the lower hosel component wherein the lightweight face return extension is made out of a second material, and a rear lightweight aft body, adapted to engage an aft portion of the lightweight face return extension, wherein a density of the first material is greater than a density of the second material.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Before beginning the discussion on the current inventive golf club head and its performance criteria, it is worthwhile to note here that the discussion below will be based on a coordinate system 101 and axis of measurement that is critical to the proper valuation of the performance numbers. Hence, it is important to recognize here that although the specific names given for the measurements below are important to the understanding of the current invention, the naming nomenclature should not be viewed in vacuum. Rather, the importance is the numbers presented below needs to be taken in context with how the coordinate system relates to the golf club head itself. In order to provide sufficient information to avoid any ambiguity, each of the figures provided below referencing a golf club head will all be accompanied by a coordinate system that is all consistent with one another.

Figure 1:
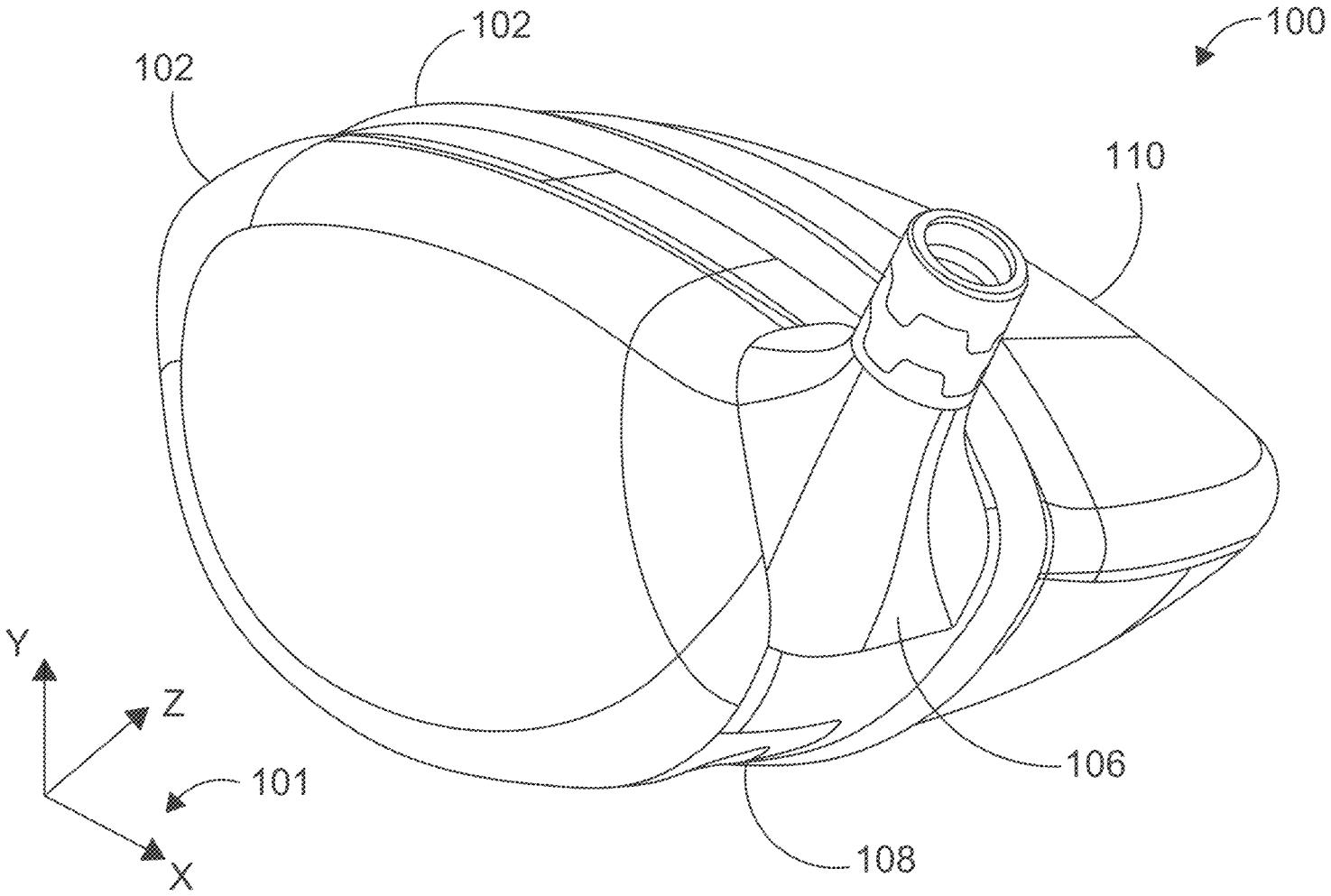
FIG. 1 of the accompanying drawings shows a perspective view of a golf club head in accordance with an embodiment of the present invention.

Pursuant to the above, and to establish the reference coordinate system for the subsequent discussion, FIG. 1 of the accompanying drawings shows the coordinate system 101 that will be used to define the various measurement and performance figures for the current invention. The x-axis used by the current discussion refers to the axis that is horizontal to the striking face from a heel to toe direction. The y-axis used by the current discussion refers to the vertical axis through the club in a crown to sole direction. The z-axis used by the current discussion refers to the horizontal axis that is horizontal front to back in a forward and rear direction. Alternatively speaking, it can be the x-axis is defined as a horizontal axis tangent to a geometric center of the striking face with the positive direction towards a heel of the golf club head, a y-axis is a horizontal axis orthogonal to the x-axis with a positive direction towards a top of the golf club head, and a z-axis being orthogonal to both the x-axis and the y-axis with a positive direction towards a front of the golf club head. The x-y-z coordinate system described above shall be the same for all subsequent discussions.

FIG. 1 of the accompanying drawings shows a perspective view of a golf club head 100 in accordance with an exemplary embodiment of the present invention. The exemplary embodiment of the present invention shown in FIG. 1 may be further comprised of several sub-components to make up the golf club head 100 itself. More specifically, the golf club head 100 shown here in FIG. 1 may have a striking face component 102, a lightweight face return extension 104, a rear lightweight aft body 110, an upper hosel component 106 and a lower hosel component 108, with the rear lightweight aft body 110 being potentially being formed out of several additional sub-components. The golf club head 100 shown here is unique in its construction because it has a simple and compact striking face component 102 that can be formed out of a simple stamped sheet metallic material because all the features having more complicated geometry such as the lightweight face return extension 104, the upper hosel component 106, and the lower hosel component 108 are all now formed as separate components. The ability to use a stamped sheet type metallic material to form the striking face component 102 of a golf club head is beneficial because it allows more variety of materials to be used, and several of them have significant performance benefits.

In this current exemplary embodiment of the present invention, the striking face component 102 may be made out of a titanium type material having a density of approximately 4.5 g/cc, however, in alternative embodiments of the present invention, the striking face component 102 may be made out of other types of material capable of withstanding the impact forces of a golf ball all without departing from the scope and content of the present invention.

Figure 2:
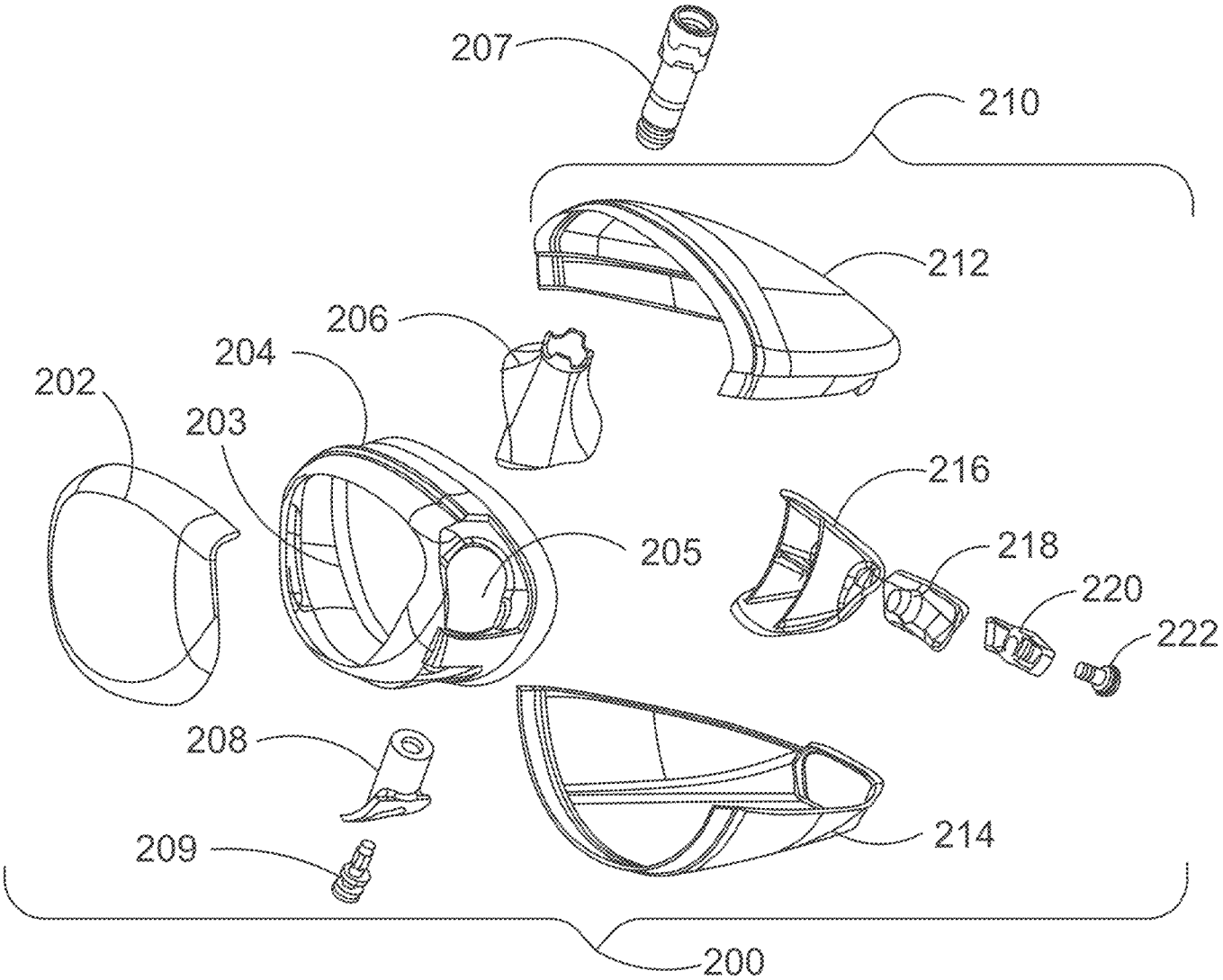
FIG. 2 of the accompanying drawings shows an exploded perspective view of a golf club head in accordance with an embodiment of the present invention.

In order to illustrate the various components of the golf club head 100 in more detail, an exploded view of the golf club head 100 is shown in FIG. 2 as golf club head 200. In the exploded view shown in FIG. 2, we can see that the striking face component 202 has a very simple geometry of a substantially planar front end combined with a partial return portion avoids the hosel portion of the golf club head 200. It should be noted here that the return portion of the striking face component 202 is significantly shorter then traditional face cup type golf club heads because the hosel component is formed separately, freeing up the need to make a striking face component 202. The striking face component 202 shown in this embodiment of the present invention may generally be made out of a titanium type material for its high strength and low weight properties, however, in alternative embodiments of the present invention, other types of high strength materials may be used without departing from the scope and content of the present invention. In place of a prior art oversized striking face component with a lengthy return, the current invention replaces the lengthy portions of the traditional return portion of a face cup design with a lightweight face return extension 204. Because the lightweight face return extension 204 does not include the upper hosel component 206 and lower hosel component 208, it can be formed out of lightweight composite material that allows more mass to be reduced from this portion of the golf club head 200 to create more discretionary mass for optimization. In the current exemplary embodiment of the present invention, the lightweight face return extension 204 may be made out of a composite type of material with a density of less than about 2.0 g/cc, however, in alternative embodiments, other types of lightweight material may be used without departing from the scope and content of the present invention so long as it is capable of reducing the overall mass of the golf club head 200. Given that the striking face component 202 is generally made from a titanium material and the lightweight face return extension 204 is made out of composite type material, it can be said that the first material used to form the striking face component 202 has a density greater than that of the second material used to form the lightweight face return extension 204.

In order to further reduce mass from the lightweight face return extension 204, the lightweight face return extension 204 has a frontal opening 203 to create an unsupported striking face portion allowing the striking face component 202 to attach to the lightweight face return extension 204 to only be supported around the perimeter. However, in alternative embodiments of the present invention, the lightweight face return extension 204 may fully support the striking face component 202 without a frontal opening 203 without departing from the scope and content of the present invention.

The upper hosel component 206 shown here in FIG. 2 is generally attached to an upper opening 205 in the lightweight face return extension 204 and is generally made out a metallic material such as titanium. The upper hosel component 206 is made from a titanium material because such component also experiences high stress levels as it attaches to a shaft adapter 207 to engage a golf shaft. Opposite the upper hosel component 206 is the lower hosel component 208, which attaches to a complimentary lower hosel opening 311 (shown in FIG. 3) in the lightweight face return extension 204. This lower hosel component 208, may be made from a different metallic material such as steel instead of titanium because it does not experience as much stress as the upper hosel component 206, but also steel having a density higher than that of titanium may be helpful in adjusting the center of gravity lower and more forward in a golf club head 200; which is often a desirable location for mass anyway. A threaded fastener 209 is also shown here in FIG. 2 that is adapted to engage the shaft adapter 207, allowing the hosel components to be secured together to the lightweight face return extension 204. The rear lightweight aft body 210 shown here in the exploded view of FIG. 2 further comprises a lightweight crown sub-shell 212, a lightweight sole sub-shell 214, a inner weight housing 216, an outer weight housing 218, a high density mass 220, and a screw 222. More details regarding the construction of the rear lightweight aft body 210, together with the various weighting components, can be found in U.S. Patent Publication No. 2022/0219049, the disclosure of which is incorporated by reference in its entirety.

Figure 3:
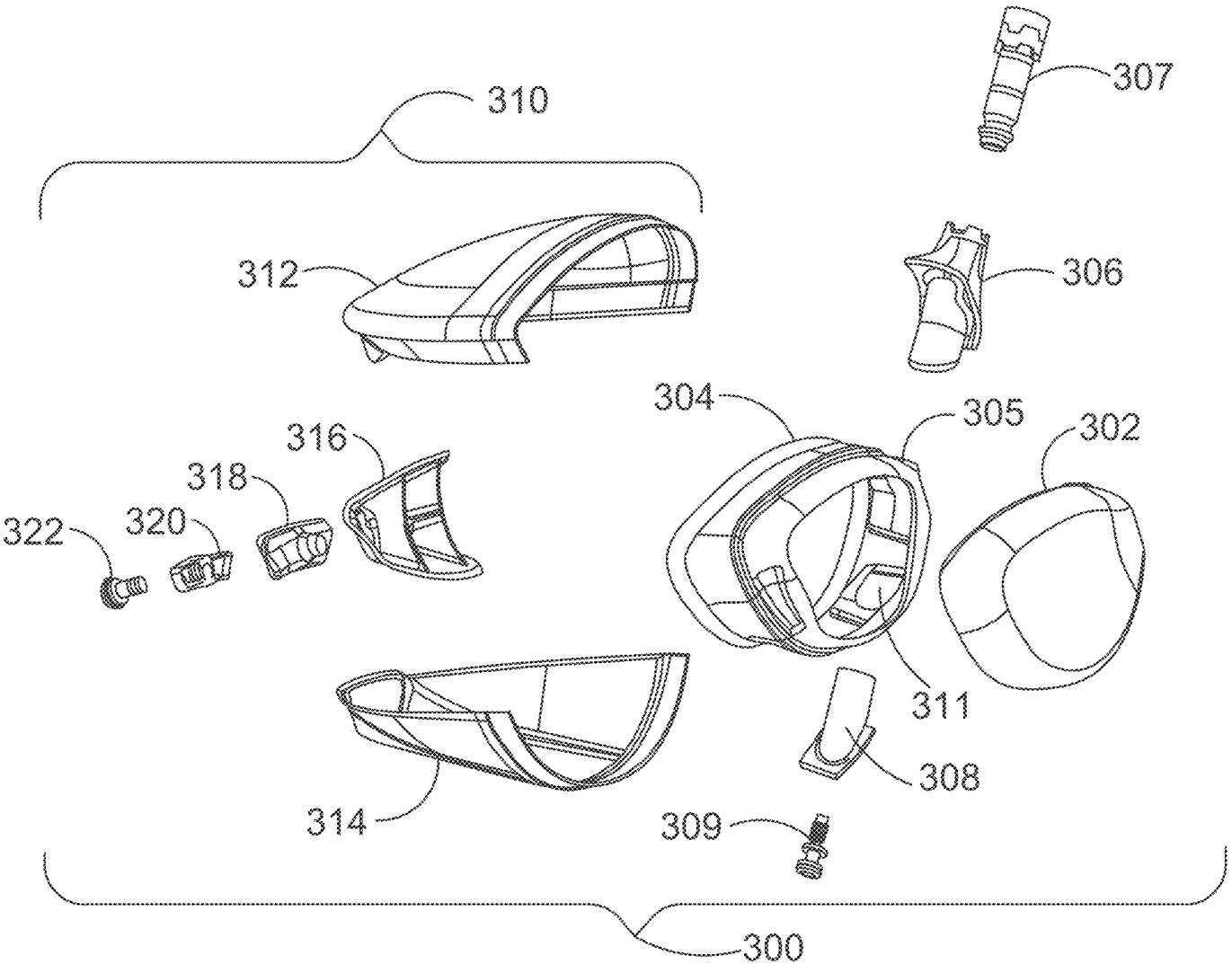
FIG. 3 of the accompanying drawings shows another exploded view of a golf club head in accordance with an embodiment of the present invention.

FIG. 3 of the accompanying drawings shows an exploded perspective view of a golf club head 300 in accordance with an exemplary embodiment of the present invention shown from a differing angle, providing a different view of the various components. In this view, the frontal portion of the golf club head 300 shows the striking face component 302 having a relatively small return portion as previously shown. The striking face component 302 is adapted to engage the lightweight face return extension 304, wherein the lightweight face return extension further comprises an upper hosel opening 305 and a lower hosel opening 311. The upper hosel opening 305 is adapted to engage an upper hosel component 306 while the lower hosel opening 311 is adapted to engage a lower hosel component 308. The upper hosel component 306 is adapted to engage a shaft adapter 307 while the lower hosel component 308 is adapted to engage a threaded fastener 309 that is ultimately engaged to the shaft adapter 307 to secure all the afore mentioned components together. Attached to the rear of these frontal components is the rear lightweight aft body 310 that is further comprised out of a lightweight crown sub-shell 312, a lightweight sole sub-shell 314, an inner weight housing 316, an outer weight housing 318, a high density mass 320 and a screw 322; all functioning similarly to the method described above in FIG. 2.

Figure 4:
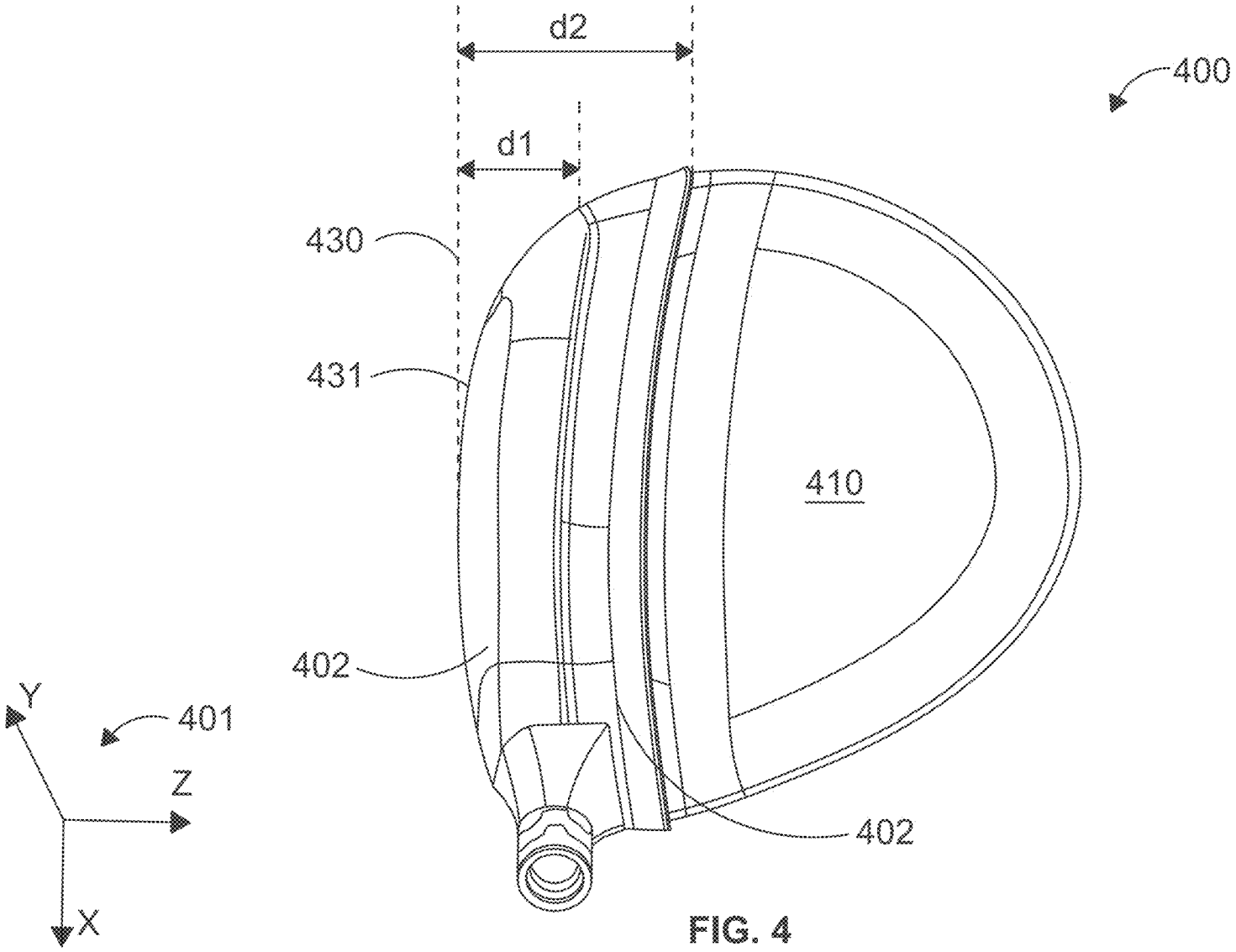
FIG. 4 of the accompanying drawings shows top crown view of a golf club head in accordance with an embodiment of the present invention.

FIG. 4 of the accompanying drawings shows a top view of a golf club head 400 in accordance with an embodiment of the present invention. In this top view of the golf club head 400, we can see the striking face component 402 having a reduced return distance located at a frontal portion of the golf club head 400, with the lightweight face return extension 404 attached to the aft portion of the golf club head 400. Finally, a rear lightweight aft body 410 is connected to the aft portion of the lightweight face return extension 404 to complete the golf club head 400. In this top view of the golf club head 400 is viewed from the x-z plane as shown in the coordinate system 401, with the face being square and the hosel placed at a 60 degree lie angle.

In this top view of the golf club head 400 we can see that there is a frontal plane 430 located along the x-y plane at the leading edge 431 of the golf club head 400, that marks the most forward location of the golf club head 400 from which the distances of the striking face component 402 and the lightweight face return extension 404 can be measured. Striking face component depth distance d1, shown here in FIG. 4, measured from the frontal plane 430 towards the rear most point of the striking face component is generally less than about 30.0 mm, more preferably less than about 27.5 mm, and most preferably less than about 25 mm. Alternatively speaking, it can be said that no portion of the striking face component is located more than about 30.0 mm from the leading edge 431 along the z-axis, more preferably no more than about 27.5 mm from the leading edge 431 along the z-axis, and most preferably no more than about 25 mm from the leading edge 431 along the z-axis.

FIG. 4 of the accompanying drawings also shows a lightweight face return extension distance d2, measured from the frontal plane 430 to the rear most point of the lightweight face return extension 404, is generally greater than about 40.0 mm, more preferably greater than about 42.5 mm, and most preferably greater than about 45.0 mm. Alternatively speaking, it can be said that the rearmost portion of said lightweight face return extension 404 is located at a distance of greater than about 40.0 mm away from the leading edge, along the z-axis, more preferably greater than about 42.5 mm away from the leading edge along the z-axis, and most preferably greater than about 45.0 mm away from the leading edge along the z-axis.

Because the lightweight face return extension distance d2 is measured from the frontal plane 430, a simple subtraction of the striking face component depth distance d1 from lightweight face return extension distance d2 will yield the component distance of the lightweight face return extension depth of greater than about 10.0 mm, more preferably greater than about 15.0 mm, and most preferably greater than about 20.0 mm.

Figure 5:
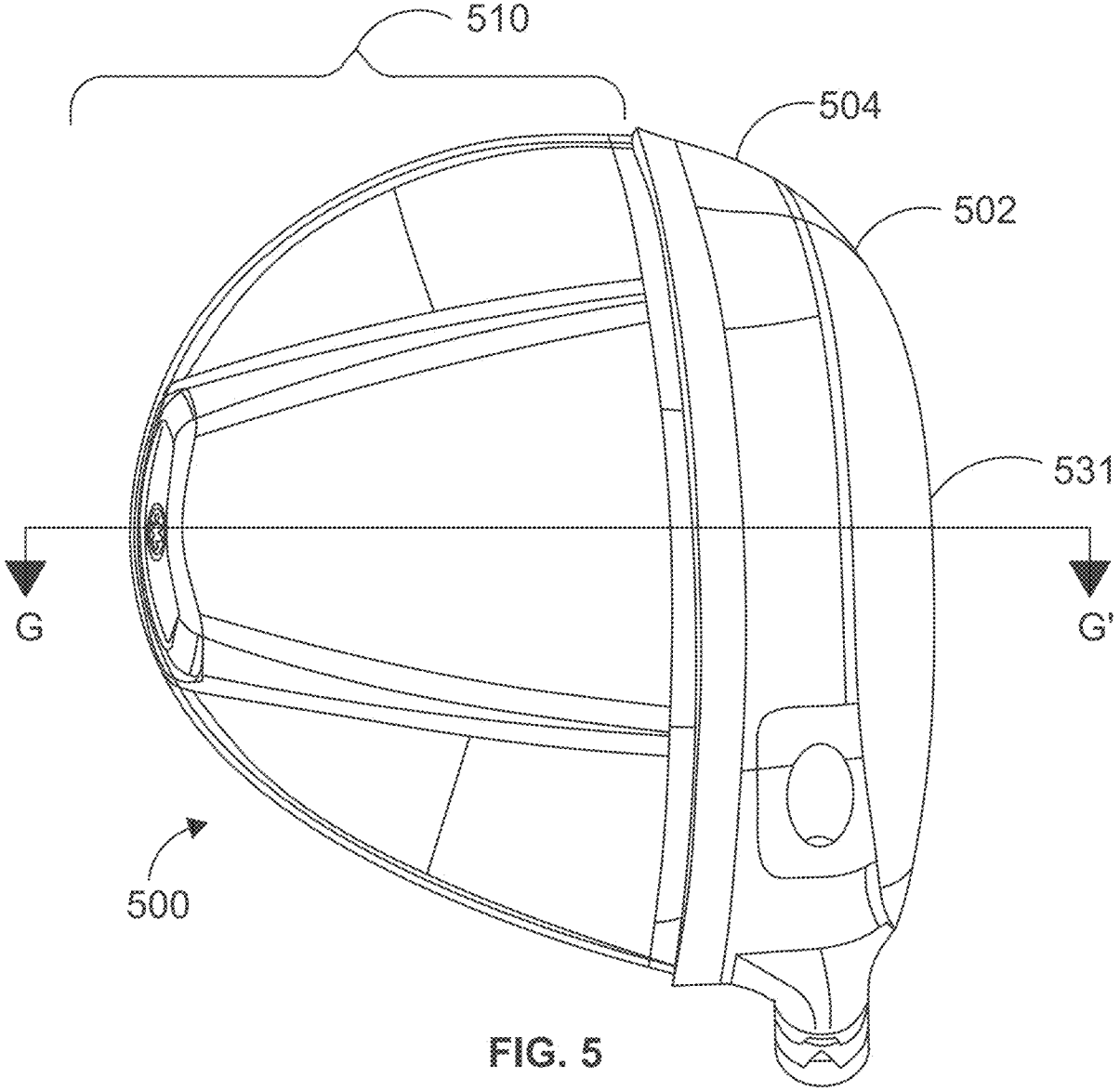
FIG. 5 of the accompanying drawings shows a bottom sole view of a golf club head in accordance with an embodiment of the present invention.

FIG. 5 of the accompanying drawings shows a sole view of a golf club head 500 in accordance with an alternative embodiment of the present invention. In this sole view, cross-sectional line 6-6' is shown across the center of the golf club head 500, passing through the leading edge 531, to allow more details regarding the bond between the striking face component 502, the lightweight return extension 504 and the remaining rear lightweight aft body 510 to be shown more clearly.

Figure 6:
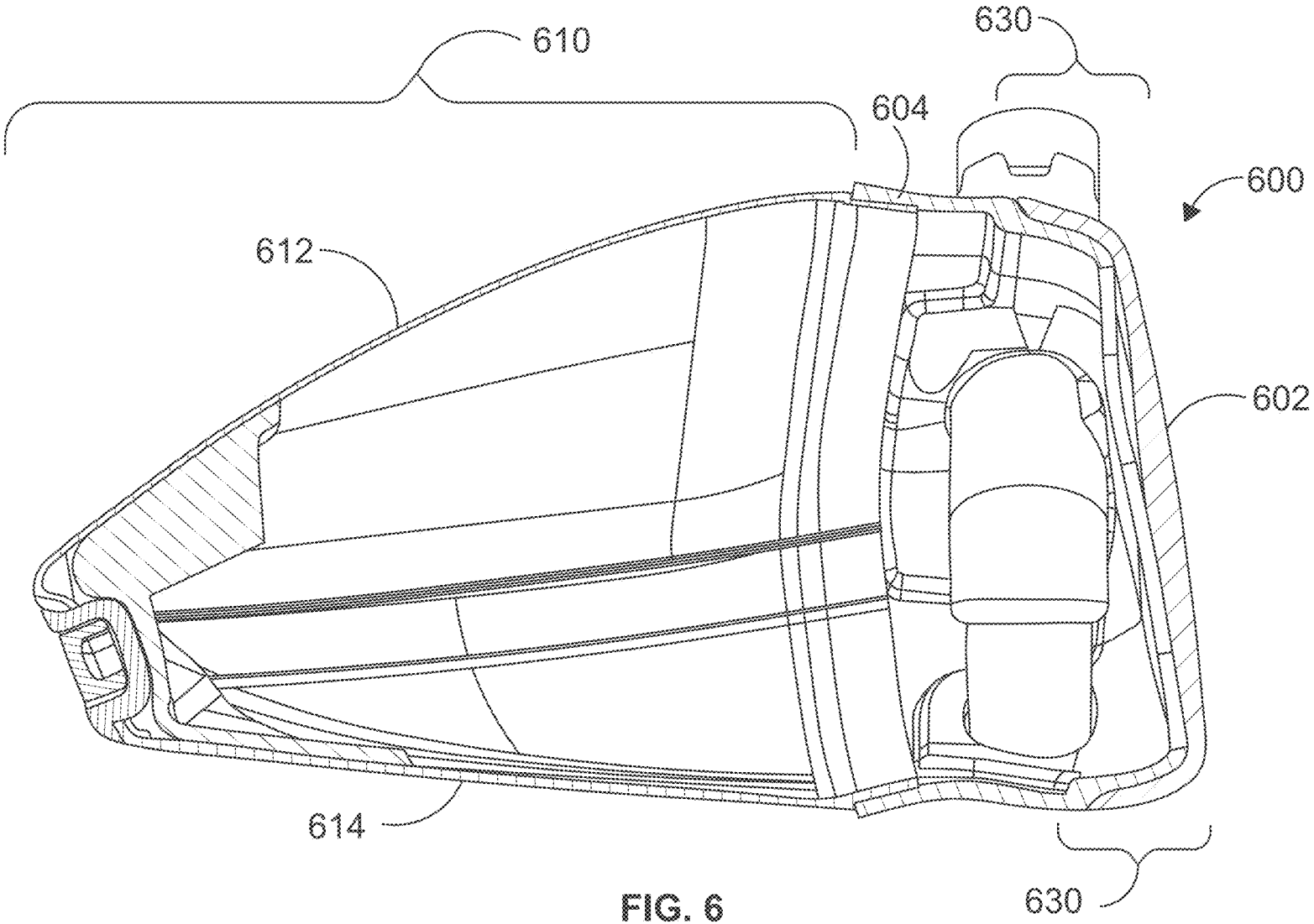
FIG. 6 of the accompanying drawings shows a cross-sectional view of a golf club head in accordance with an embodiment of the present invention, taken along cross-sectional line 6-6' shown in FIG. 5.

FIG. 6 of the accompanying drawings shows a cross-sectional view of a golf club head 600 taken along cross-sectional line 6-6' shown in FIG. 5. In this cross-sectional view of the golf club head 600 shown in FIG. 6, we can see that the striking face component 602 forms the frontal portion of the golf club head 600 and has a stubby return portion 630 the is reduced in distance to allow for not only mass reduction, but also ease of manufacturing. Incorporating a stubby return portion 630 having a reduced distance reduces weight because the material used to form the striking face component 602 may generally need to be made out of a high strength material to withstand the impact forces with a golf ball, and those materials are generally heavier than materials used to form the other components of the golf club head 600 that doesn't require such high strength. Incorporating a stubby return portion 630 also increase the ease of manufacturing because the striking face component 602 now with its stubbier shape, no longer needs to form the various ancillary components of a golf club head 600 that is traditionally formed as one piece in a conventional face cup construction such as the hosel. With the removal of the need to form such a component, the striking face component 602 can easily be made out of a stamped sheet of titanium material that contains a simple bend forming the stubbier return portion 630, resulting in a component that is much easier to manufacture.

In this cross-sectional view shown in FIG. 6, we can see the bond between the striking face component 602 and the lightweight face return extension 604. The two components are joined together via an overlapping joint as shown in FIG. 5, with the striking face component 602 forming the external portion of the golf club head 600 at the joint. Similarly, the bond between the lightweight face return extension 604 and the rear lightweight aft body 610 is also achieved via an overlapping joint as shown in FIG. 6, this time with the lightweight face return extension 604 forming the external portion of the golf club head 600 at the joint. Although joining together neighboring components using overlapping lap joints is not new, even when applying it to joining golf club components, the present invention is unique in the distance of the overlap between the striking face component 602, the lightweight face return extension 604, and the lightweight aft body 610 as well as their relative overlapping distances to one another is unique and critical to the present invention to help distribute the stress experienced by a golf club when impacting a golf ball.

Figure 7:
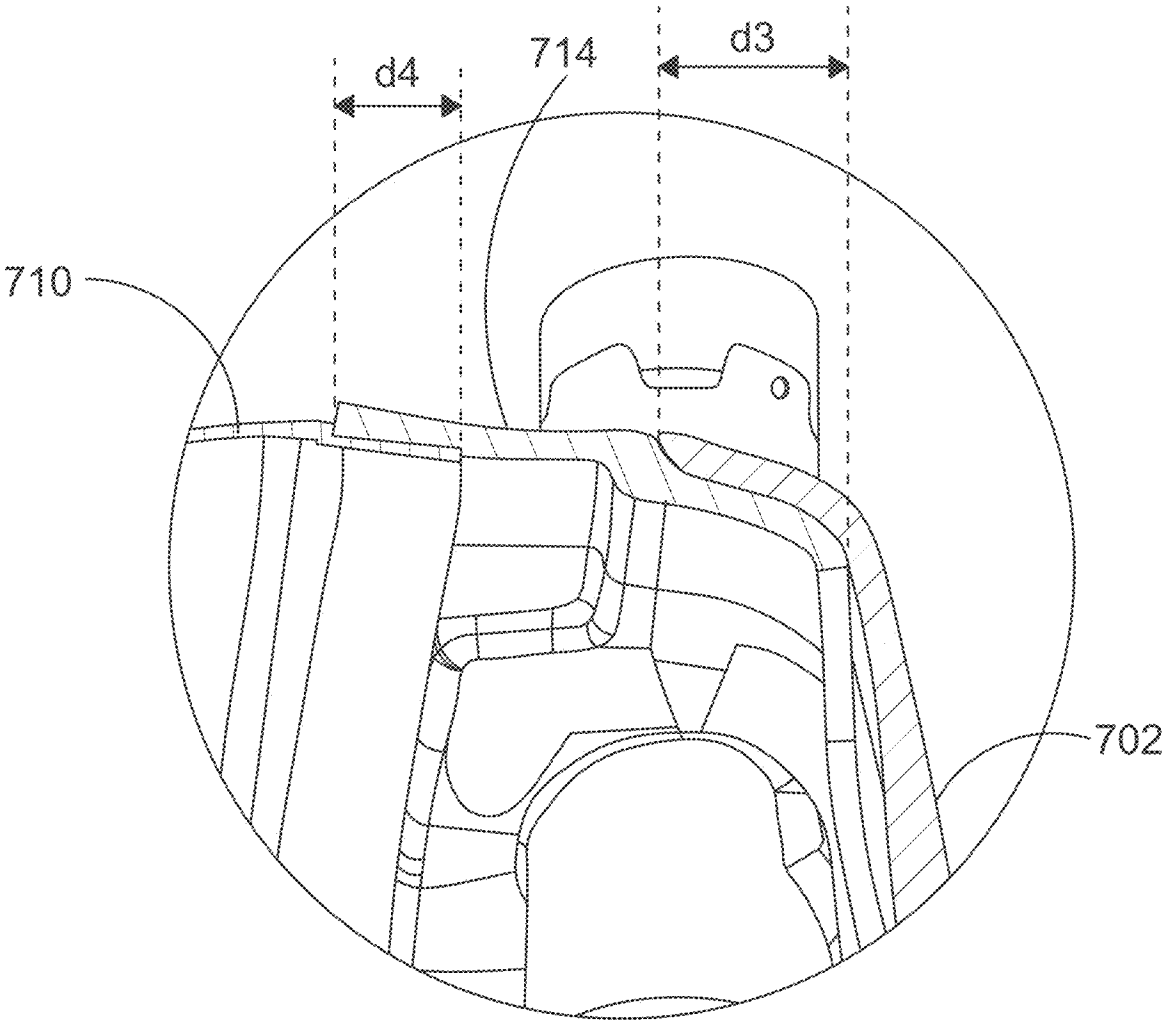
FIG. 7 of the accompanying drawings shows an enlarged partial cross-sectional view of a crown transition region of a golf club head in accordance with an embodiment of the present invention.
Figure 8:
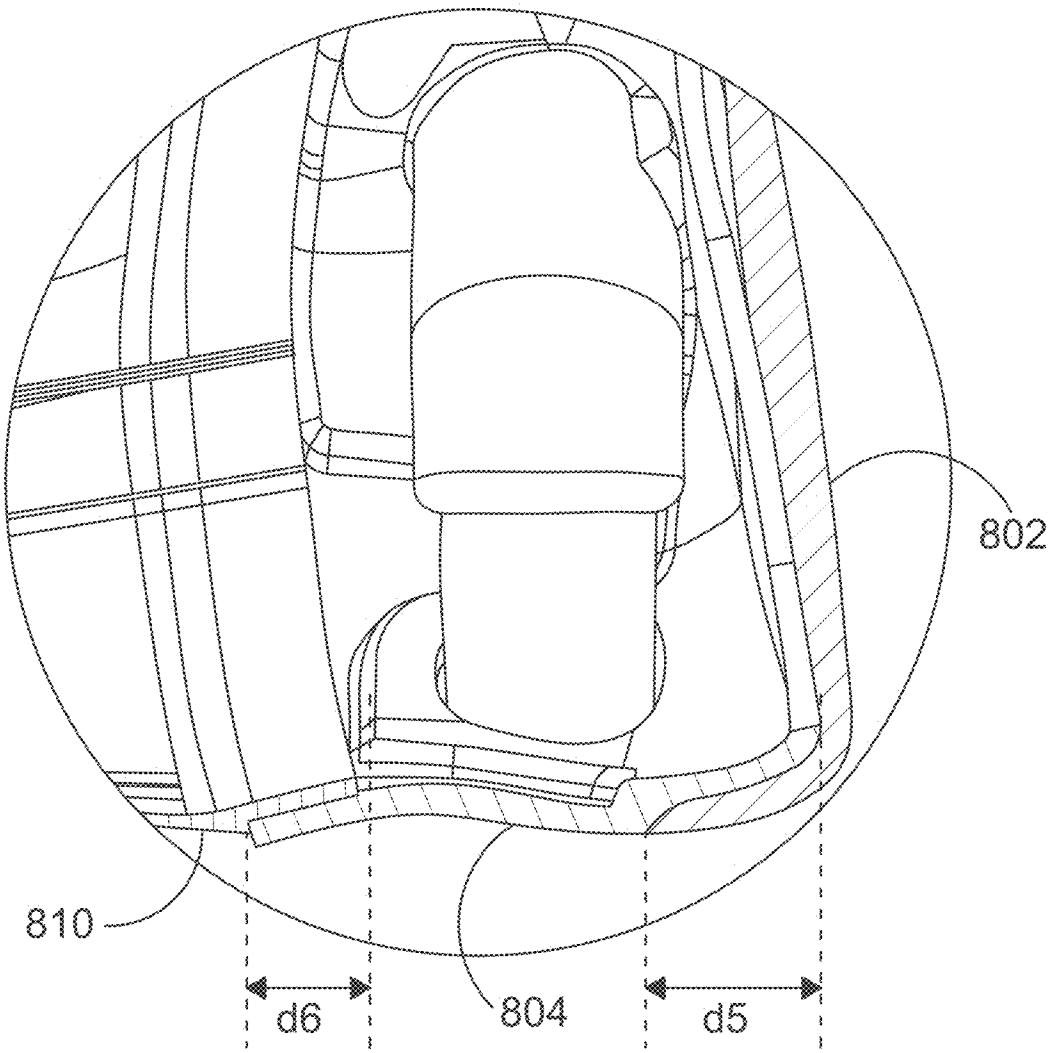
FIG. 8 of the accompanying drawings shows an enlarged partial cross-sectional view of a sole transition region of a golf club head in accordance with an embodiment of the present invention.

In order to better illustrate these important measurements and generate the ratios, enlarged views of the upper and lower portions of the lightweight face return extension 604 is provided in FIG. 7 and FIG. 8.

FIG. 7 of the accompanying drawings shows an enlarged partial cross-sectional view of the upper portion of the lightweight face return extension 704 in accordance with an embodiment of the present invention. In this enlarged partial cross-sectional view, we can see that the overlap between the upper portion of the striking face component 702 and the upper portion of the lightweight face return extension 704 is identified as upper frontal overlap distance d3. Upper frontal overlap distance d3, in accordance with the present invention may generally be between about 8.0 mm to about 12.0 mm, more preferably between about 9.0 mm to about 11.0 mm, and most preferably about 10.0 mm. Upper rear overlap distance d4, shown here in FIG. 7, measures the overlap between the upper portion of the lightweight face return extension 704 and the upper portion of the lightweight aft body 710, is generally between about 5.0 mm and about 8.0 mm, more preferably between about 6.0 mm and about 7.0 mm, and most preferably about 6.7 mm. A ratio of the frontal and rear overlapping distances of the lightweight face return extension 704 may help quantify the amount of overlap needed to help dissipate the impact stresses of a golf club head with a golf ball, and is quantified here as the Upper Extension Overlap Ratio, defined by Equation (1) below:

$$\text{Upper Extension Overlap Ratio} = \frac{\text{Upper Frontal Overlap Distance } d3}{\text{Upper Rear Overlap Distance } d4}. \quad \text{Eq. (1)}$$

The Upper Extension Overlap Ratio in accordance with the present invention is between about 1 and about 2.4, more preferably between about 1.2 and about 1.8, and most preferably about 1.4.

FIG. 8 of the accompanying drawings shows an enlarged partial cross-sectional view of the lower portion of the lightweight face return extension 804 in accordance with an embodiment of the present invention, showing the striking face component 802 and the rear lightweight aft body 810 as well. The overlapping joints shown here is similar to what is shown in the upper portion of the lightweight face return extension 704 in FIG. 7, but the dimensions are significantly different. First and foremost, the lower frontal overlap distance d5, in accordance with the present invention may generally be between about 8.0 mm to about 12.0 mm, more preferably between about 9.0 mm to about 11.0 mm, and most preferably about 10.0 mm; which is similar to the values for upper frontal overlap distance d5 disclosed previously. Similarly, the lower rear overlap distance d6 in this current embodiment is also designed to be very close to the upper rear overlap distance d4 shown in FIG. 7. More specifically, the lower rear overlap distance d6 may generally also be between about 5.0 mm and about 8.0 mm, more preferably between about 6.0 mm and about 7.0 mm, and most preferably about 6.7 mm. A ratio of the frontal and rear overlapping distances of the lightweight face return extension 804 may help quantify the amount of overlap needed to help dissipate the impact stresses of a golf club head with a golf ball, and is quantified here as the Lower Extension Overlap Ratio, defined by Equation (1) below:

$$\text{Lower Extension Overlap Ratio} = \frac{\text{Lower Frontal Overlap Distance } d5}{\text{Lower Rear Overlap Distance } d6}. \quad \text{Eq. (2)}$$

The Upper Extension Overlap Ratio in accordance with the present invention is between about 1 and about 2.4, more preferably between about 1.2 and about 1.8, and most preferably about 1.4.

Figure 9:
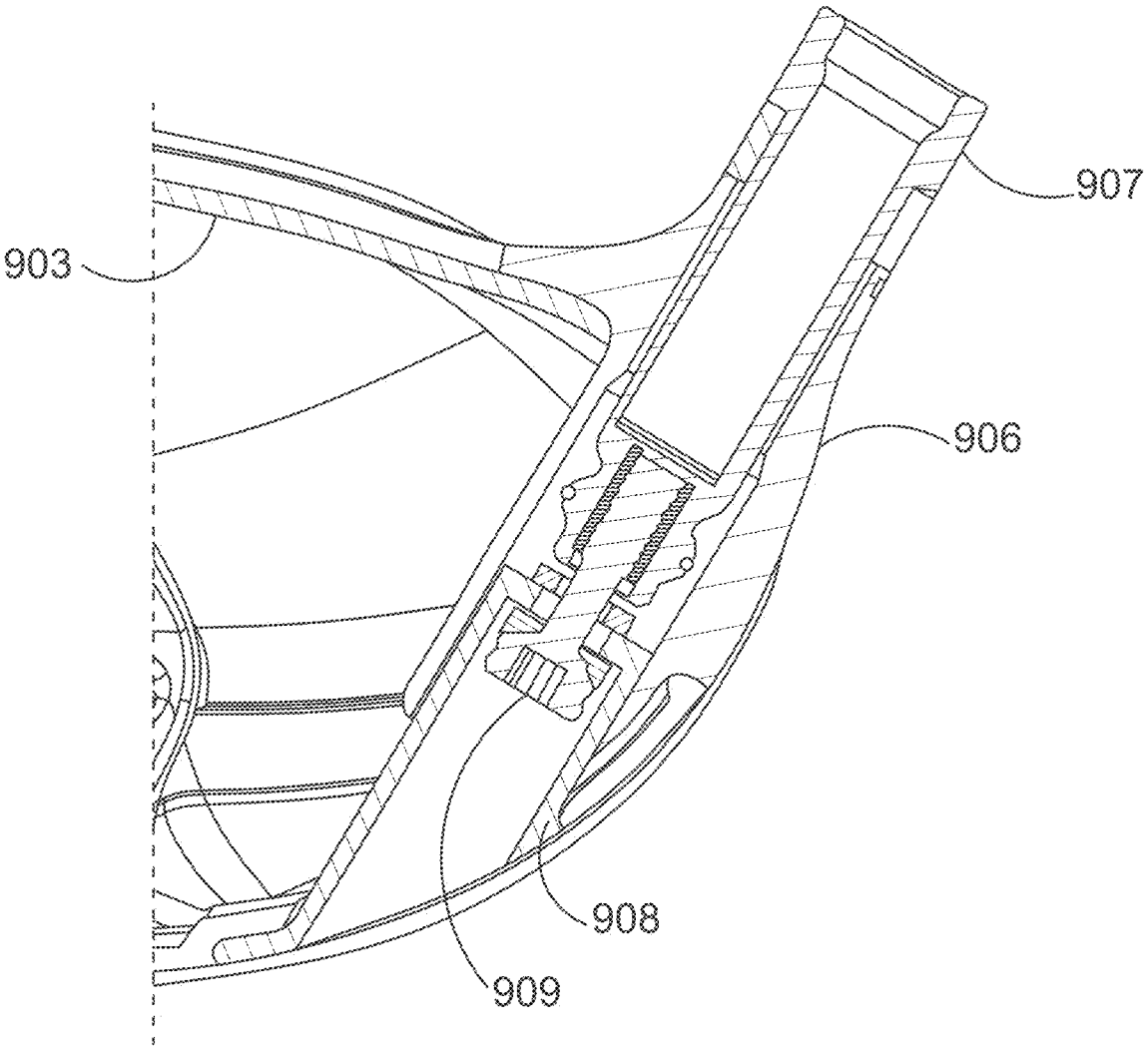
FIG. 9 of the accompanying drawings shows a cross-sectional view of a hosel portion of a golf club head in accordance with an embodiment of the present invention.

FIG. 9 of the accompanying drawings shows a cross-sectional view of a hosel portion of a golf club head, allowing the various components that form the hosel portion of the golf club head to be shown in more detail, illustrating their relationship with one another. More specifically, in FIG. 9, we can see that the hosel portion comprises of a shaft adapter 907 at a top portion of the hosel portion that is adapted to engage an upper hosel component 906. Coming in from the bottom of the hosel portion is a lower hosel component 908 that engages the upper hosel component 906 via a threaded fastener that threads into the shaft adapter 907. These hosel components work together to attach to the lightweight face return extension 903 to complete the hosel region of the golf club head.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face component, having a return portion, located at a frontal portion of said golf club head, adapted to strike a golf ball, wherein said striking face component is made out of a first material, wherein said striking face component forms a leading edge of said golf club head, a lightweight face return extension, adapted to engage an aft portion of said striking face component, wherein said lightweight face return extension is made out of a second material, and a rear lightweight aft body, adapted to engage an aft portion of said lightweight face return extension, wherein a density of said first material is greater than a density of said second material, wherein no portion of said striking face component is located beyond more than about 30.0 mm from said leading edge, measured along a z-axis, wherein a rearmost portion of said lightweight face return extension is located at a distance of greater than about 40.0 mm away from said leading edge, measured along said z-axis, And wherein said golf club head has an Upper Extension Overlap Ratio of between about 1.2 and about 1.8, said Upper Extension Overlap Ratio defined as, Upper Extension Overlap Ratio=Upper Frontal Overlap Distance d3/Upper Rear Overlap Distance d4.

2. The golf club head of claim 1, wherein no portion of said striking face component is located beyond more than about 27.5 mm from said leading edge, measured along said z-axis.

3. The golf club head of claim 2, wherein no portion of said striking face component is located beyond more than about 25 mm from said leading edge, measured along said z-axis.

4. The golf club head of claim 1, wherein said rearmost portion of said lightweight face return extension is located at a distance of greater than about 42.5 mm away from said leading edge, measured along said z-axis.

5. The golf club head of claim 4, wherein said rearmost portion of said lightweight face return extension is located at a distance of greater than about 45.0 mm away from said leading edge, measured along said z-axis.

6. The golf club head of claim 1, wherein said Upper Extension Overlap Ratio is about 1.4.

7. The golf club head of claim 1, wherein said golf club head has a Lower Extension Overlap Ratio of between about 1 and about 2.4, said Lower Extension Overlap Ratio defined as, $$\text{Lower Extension Overlap Ratio} = \frac{\text{Lower Frontal Overlap Distance } d5}{\text{Lower Rear Overlap Distance } d6}.$$

8. The golf club head of claim 7, wherein said Lower Extension Overlap Ratio is between about 1.2 and about 1.8.

9. The golf club head of claim 8, wherein said Lower Extension Overlap Ratio is about 1.4.

10. A golf club head comprising:

a striking face component, having a return portion, located at a frontal portion of said golf club head, adapted to strike a golf ball, wherein said striking face component is made out of a first material, wherein said striking face component forms a leading edge of said golf club head, a lightweight face return extension, adapted to engage an aft portion of said striking face component, wherein said lightweight face return extension is made out of a second material, and a rear lightweight aft body, adapted to engage an aft portion of said lightweight face return extension, wherein a density of said first material is greater than a density of said second material, wherein said golf club head has an Upper Extension Overlap Ratio of between about 1 and about 2.4, said Upper Extension Overlap Ratio defined as, $$\text{Upper Extension Overlap Ratio} = \frac{\text{Upper Frontal Overlap Distance } d3}{\text{Upper Rear Overlap Distance } d4},$$

and wherein said golf club head has a Lower Extension Overlap Ratio of between about 1 and about 2.4, said Lower Extension Overlap Ratio defined as, $$\text{Lower Extension Overlap Ratio} = \frac{\text{Lower Frontal Overlap Distance } d5}{\text{Lower Rear Overlap Distance } d6}.$$

wherein said Upper Extension Overlap Ratio is between about 1.2 and 1.8, and wherein said Lower Extension Overlap Ratio is between about 1.2 and 1.8.

11. The golf club head of claim 10, wherein said Upper Extension Overlap Ratio is about 1.4, and wherein said Lower Extension Overlap Ratio is about 1.4.

12. The golf club head of claim 10, wherein no portion of said striking face component is located beyond more than about 30.0 mm from said leading edge, measured along a z-axis.

13. The golf club head of claim 12, wherein no portion of said striking face component is located beyond more than about 27.5 mm from said leading edge, measured along said z-axis.

14. The golf club head of claim 13, wherein no portion of said striking face component is located beyond more than about 25 mm from said leading edge, measured along said z-axis.

* * * * *